United States Patent [19]

Morningstar et al.

[11] Patent Number: 4,659,166

[45] Date of Patent: Apr. 21, 1987

[54] CONNECTOR FOR MULTIPLE COAXIAL CABLES

[75] Inventors: Leroy J. Morningstar, Middletown; Charles S. Blichasz, Harrisburg, both of Pa.

[73] Assignee: AMP Incorporated, Harrisburg, Pa.

[21] Appl. No.: 797,365

[22] Filed: Nov. 12, 1985

[51] Int. Cl.[4] ..... H01R 17/18

[52] U.S. Cl. ..... 339/177 R; 339/196 M; 339/208

[58] Field of Search ..... 339/177, 143 R, 107, 339/97 P, 99 R, 125 R, 126 J, 126 R, 103 R, 103 M, 196 M, 208

[56] References Cited

U.S. PATENT DOCUMENTS

| | | | |
|---|---|---|---|
| 2,757,351 | 7/1956 | Klostermann | 339/177 R |
| 3,128,138 | 4/1964 | Noschese | 339/177 R |
| 3,319,211 | 5/1967 | Smith et al. | 339/177 R |
| 3,335,394 | 8/1967 | Miller | 339/208 |
| 3,354,454 | 11/1967 | Rueger | 339/208 |
| 3,566,334 | 2/1971 | Ziegler, Jr. | 339/177 R |
| 3,599,166 | 8/1971 | Cea | 339/177 R |
| 4,210,380 | 7/1980 | Brzostek | 339/107 |
| 4,549,780 | 10/1985 | Bertini et al. | 339/107 |

*Primary Examiner*—Gil Weidenfeld
*Assistant Examiner*—David Pirlot
*Attorney, Agent, or Firm*—Gerald K. Kita

[57] ABSTRACT

An electrical connector (1), comprising, an insulative body (20) having multiple cavities (21), electrical coaxial plugs (4) in respective cavities (21), coaxial cables (3) extending from the plugs (4) and projecting from an electrical cable (2), insulative covers (37) superimposed on one another and covering the coaxial cables (3), end walls (43) of the covers (37) engaging the electrical cable (2), the plugs (4) extending through front walls (39) of the covers (37) and being received in respective recesses (42), the front walls (39) partially covering the cavities (21) in the body (20), and fingers (28) on the body (20) overlapping respective front walls (39) of each cover (37).

5 Claims, 6 Drawing Figures

CONNECTOR FOR MULTIPLE COAXIAL CABLES

FIELD OF THE INVENTION

The invention relates to an electrical connector for electrical coaxial cables of a television camera, and more particularly, to an electrical connector for interconnecting three coaxial cables of a three color television camera to electronic apparatus for previewing the image from the camera and selecting the image for television broadcast.

BACKGROUND OF THE INVENTION

A television camera converts an image viewed by the camera into three electronic signals, each of a different color. The three electronic signals are transmitted along respective three coaxial cables projecting from the camera. The coaxial cables are coupled to electronic previewing apparatus for previewing a television image produced by the camera prior to allowing broadcast of the image to the public.

For example, multiple television cameras are used to record a sporting event from different vantage points. All the cameras have their respective coaxial cables coupled to previewing apparatus which displays the images being produced by the cameras and switches to the image which has preference over the others for broadcast to the public.

There is a need for an electrical connector capable of coupling and uncoupling the three coaxial cables of a television camera to the previewing apparatus. The connector must have a feature for preventing coupling unless the cables are oriented in a desired sequence. The connector must anchor the cables to prevent their uncoupling while the cables are pulled along by the camera as the camera is moved from place to place. The connector must be low in cost and fabricated simply with few parts.

A known coaxial plug is disclosed in U.S. Pat. No. 3,221,290, issued Nov. 30, 1965 to F. B. Stark, et al. Three such coaxial plugs are connected to respective coaxial cables of a television camera and are mounted in a housing of insulation material. The housing has polarized jack screws for anchoring to an electronic input panel associated with, for example, an electronic previewing apparatus for previewing an image produced by the camera. Insulative covers anchor the coaxial plugs to the housing, and the covers themselves are secured removably to the housing.

An object of the invention is to provide an electrical connector for anchoring three coaxial plugs connected to respective coaxial cables.

Another object is to provide an electrical connector of low cost and fabricated with few parts for anchoring three coaxial cables, for arranging the cables in a desired order of sequence and for coupling the cables removably to a panel of electronic apparatus.

Other objects and advantages of the invention are apparent from the detailed description and the accompanying drawings.

DETAILED DESCRIPTION OF THE INVENTION

Figure 1:
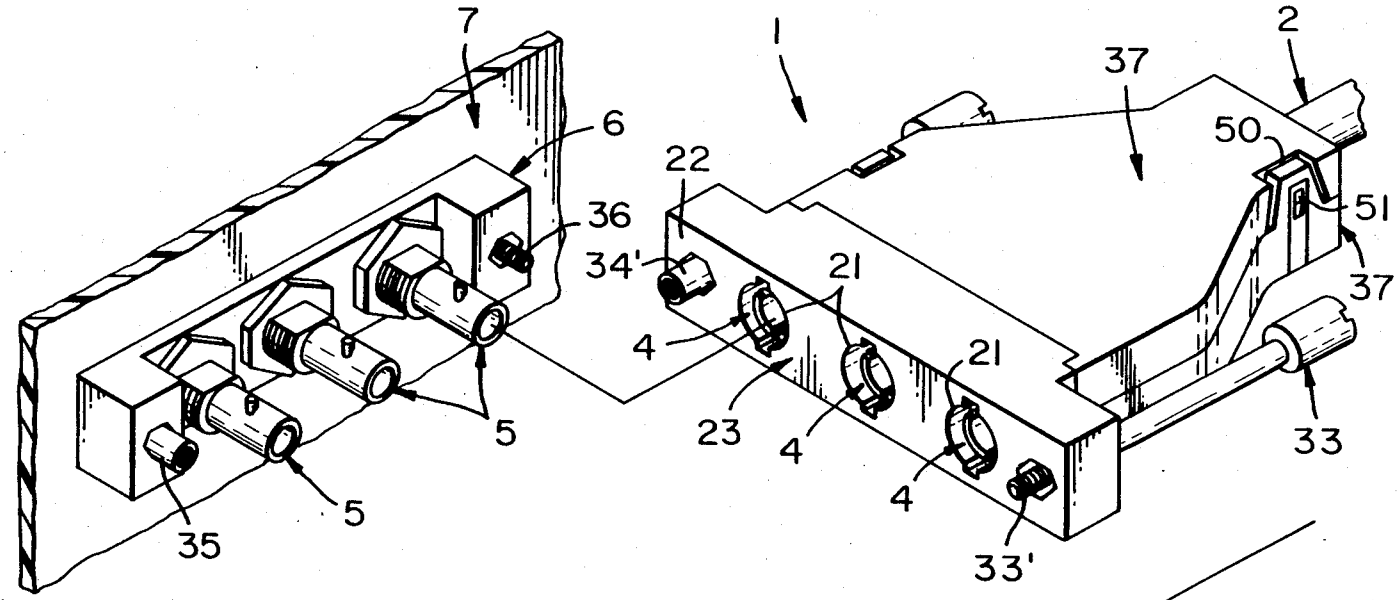
FIG. 1 is a fragmentary isometric view of a connector according to the invention shown exploded away from a panel of an electronic apparatus, now shown.
Figure 2:
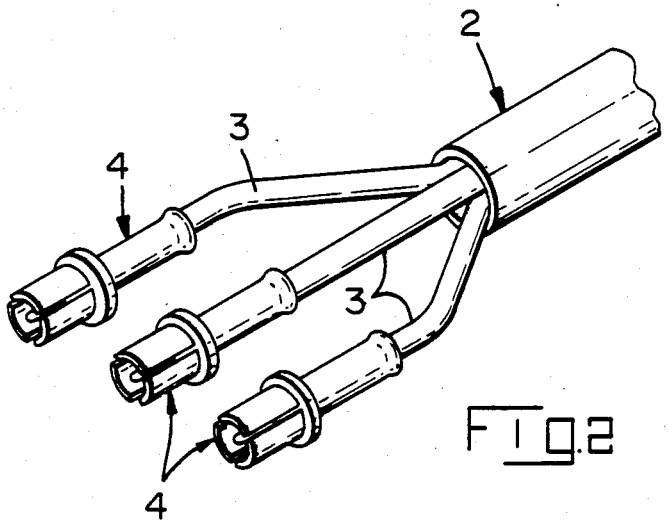
FIG. 2 is a fragmentary perspective view of an electrical cable comprised of three similar coaxial cables connected with respective coaxial plugs.

With reference to FIG. 1, an electrical connector 1 according to the invention is connected to an electrical cable 2. As shown in FIG. 2 the cable 2 has three coaxial cables 3 connected respectively to three coaxial plugs 4. The plugs 4 are to be coupled and uncoupled to corresponding electrical jacks 5 mounted in a row along an insulative header 6 which is a body of insulative material. The header 6 is mounted on a panel 7, which is representatively shown in FIG. 1, and which is a common device found on an electronic apparatus, not shown, such as a television previewing apparatus. The connector 1 is useful for coupling and uncoupling the plugs 4 with corresponding jacks 5.

Figure 4:
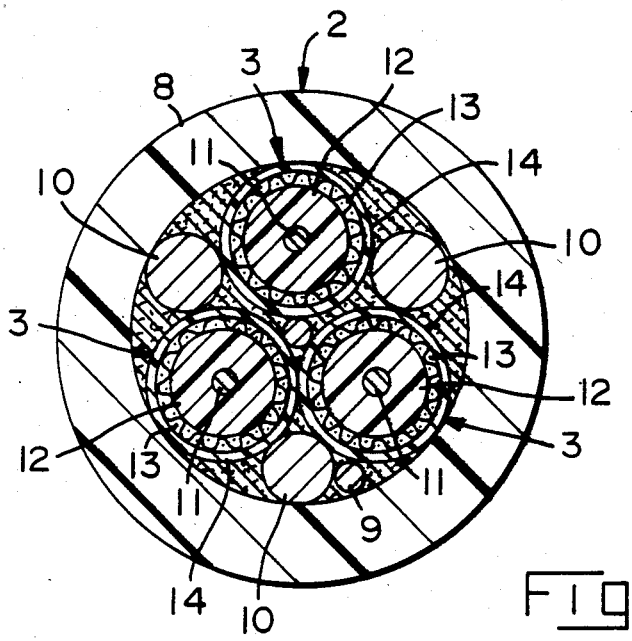
FIG. 4 is an enlarged cross section view of one of the coaxial cables.

The cable 2 is shown in FIG. 4 as comprising an outer jacket 8 of polyurethane, for example, surrounding the coaxial cables 3, and a conductive elongated drain wire 9 and elongated strengthening strands 10 for resisting tension forces applied to the cable 2.

Figure 3:
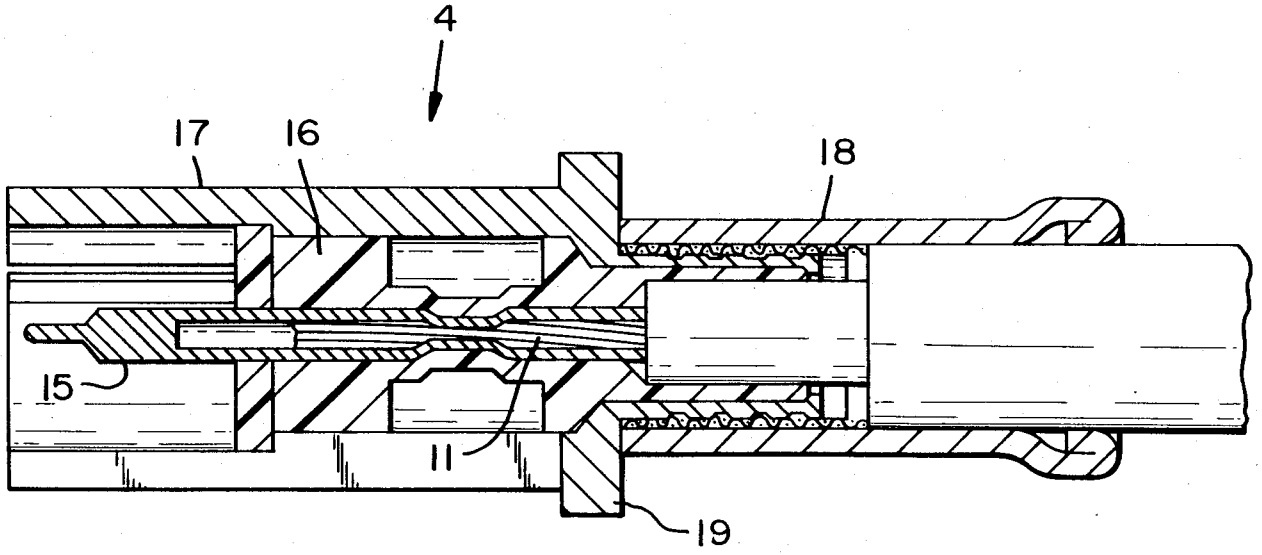
FIG. 3 is a fragmentary section view of one of the coaxial cables and a respective coaxial plug.

As shown in FIGS. 3 and 4, each coaxial cable 3 comprises an elongated center conductor 11 surrounded by an elongated layer of dielectric material 12, in turn, surrounded by an elongated conductive jacket 13 of braided wires, in turn, surrounded by an insulative jacket 14.

FIGS. 2 and 3 show a representative coaxial plug 4 connected to a corresponding coaxial cable 3. The coaxial plug 4 is known from the above referenced U.S. Pat. No. 3,221,290, and is more fully described therein. The coaxial plug 4 comprises a conductive center contact 15 connected to a corresponding center conductor 11 and surrounded by an insulative dielectric body 16, in turn, surrounded by a conductive shell 17. A conductive sleeve shaped ferrule 18 surrounds the conductive braid 13 of the coaxial cable 3 and is radially compressed to engage together the braid 13 and the shell 17. The shell 17 has a radially outward projecting flange 19 utilized to anchor the plug 4 in the connector 1.

Figure 5:
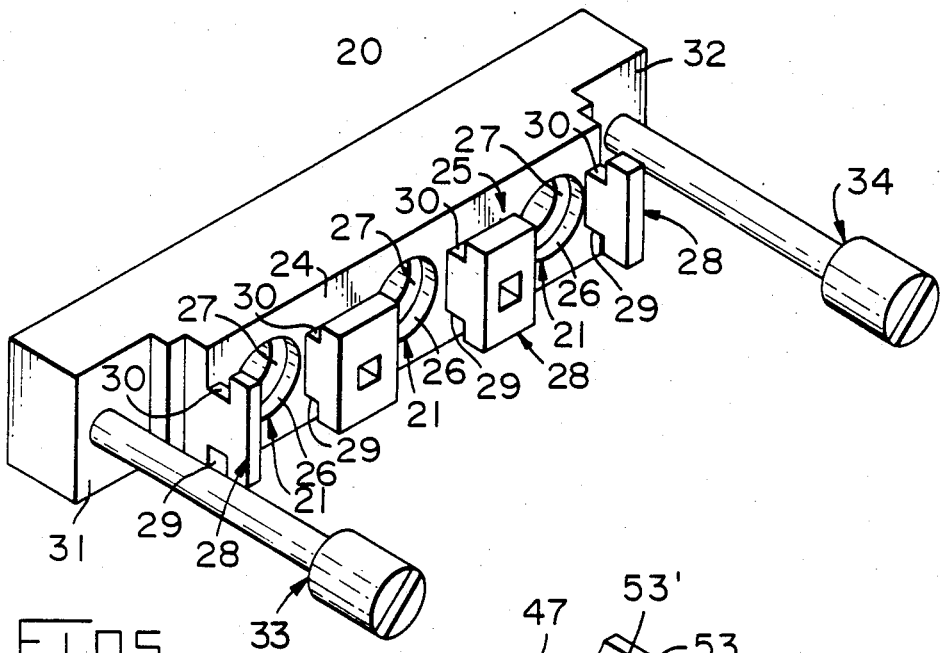
FIG. 5 is an enlarged isometric view of an insulative, one piece body comprising a portion of a housing for the coaxial plugs.

FIGS. 1 and 5 illustrate a body 20 molded from insulative plastics material and comprising a portion of the connector 1. The body 20 includes a cavity 21 for each plug 4 communicating with a flat mating face 22 at a front end 23 of the body and projecting from front to rear and communicating with a rear wall 24 at a rearward end 25 of the body 20. Each cavity 21 has a portion 26 of enlarged diameter communicating with the rear wall 24 and providing a rearward facing shoulder 27 at the intersection of the enlarged diameter portion 26 and the remainder of the cavity 21. Each cavity 21 freely receives a plug 4 with a flange 19 of the plug 4 seated on a corresponding shoulder 27 to resist movement of the plug 4 in a forward direction. A finger 28 is adjacent each cavity 21 and projects from the rear wall 24. Each finger 28 has undercut recesses 29, 30 adjacent the rear wall 24 and facing in opposite directions from each other and toward corresponding longitudinal edges of the rear wall.

Opposite ends 31, 32 of the body extend outward laterally of the rear wall. Fastening means in the form of jack screws 33, 34 are mounted for rotation respectively in the ends 31, 32. The jack screws 33, 34 are used to secure the body 20 removably to the header 6. For example, the body 20 is aligned with the header 6 and rotation of one of the jack screws 33 will drive an externally threaded end 33' of the jack screw 33 into threaded connection with an internally threaded socket 35 projecting from the header 6. Rotation of the other jack screw 34 that has an internally threaded socket 34' will threadably connect the socket 34 with an externally threaded post 36 projecting from the header 6. The body 20 is removably secured to the header 6 only if the jack screws 33, 34 are correctly oriented with the corresponding socket 35 and post 36 of the header 6.

Figure 6:
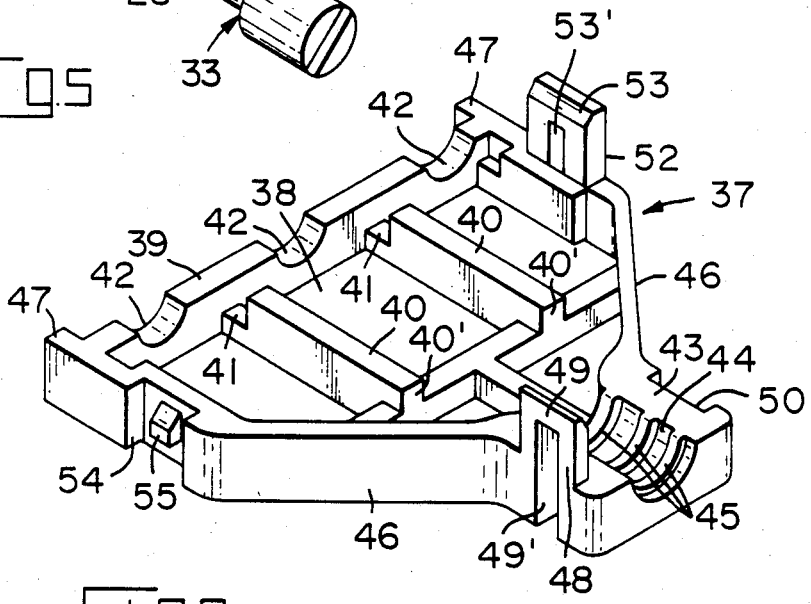
FIG. 6 is an enlarged isometric view of one of a pair of duplicate covers comprising a portion of a housing for the coaxial plugs and the coaxial cables.

FIG. 6 illustrates a cover 37 of insulative plastics material fabricated by molding, for example. The cover 37 includes a base 38 and a front wall 39 projecting from the base 38 and adapted to register against the rear wall 24 of the body 20 and enter the undercut recesses 29 facing toward the same longitudinal edge of the body 20. The fingers 28 overlap the front wall 39 of the cover 37 and retain the front wall 39 against the rear wall 24 of the housing. Ribs 40 extend over the base 38 and perpendicular to the front wall 39. Each rib 40 has a recess 41 adjacent the front wall 39 to receive a corresponding finger 28 that overlaps the front wall 39. Each rib 40 overlaps a corresponding finger 28.

The front wall 39 has a series of half-cylindrical recesses 42 through its thickness to engage and support respective plugs 4 that project from the rear wall 24 of the body 20. The front wall 39 overlaps the flanges 19 of the plugs 4. The corresponding coaxial cables 3 that extend from the plugs 4 can project in a rearward direction from the recesses 42 and extend over and along the base 38. The coaxial cables 3 would then be separated from one another by the ribs 40. The rear ends 40' of respective ribs 40 are spaced from an end wall 43 which projects from the base 38. A channel 44 extends through the thickness of the end wall 43 and communicates with the interior of the cover 37. A series of ribs 45 project from the rounded surface of the channel 44. The coaxial cables 3 that extend along the cover 37 project from the coaxial cable 2, an end portion of which extends along the recess 44 and is adapted to be gripped by the ribs 45. The front wall 39 and the end wall 43 are connected by side walls 46 which converge toward each other near where they join the rear wall 44. The side walls 46 have projecting tabs 47 located at corresponding ends of the front wall 39. The tabs 47 project along the corresponding ends of the rear wall 24 of the body 20 and thereby align the cover 37 and the body 20.

The cover 37 is intended for use with a second, identical cover 37. The identical covers 37, 37 are superimposed, one to the other, to enclose the coaxial cables 3 that project from the cable 2, and to cover partially the cavities 21 at the rear wall 24 of the body 20, thereby covering the flanges 19 and anchoring the plugs 4 to the body 20. A hasp 48 projects from one side of the end wall 43 and has its closed end 49 of a hasp opening 49' spaced from the end wall 43 and projecting in the same direction as the open side of the channel 44 in the end wall 43. An opposite side of the end wall 43 has a complementary hasp-receiving recess 40 and a latching finger 51 projecting into the hasp-receiving recess 50. One of the side walls 46 has a projecting hasp 52 with a closed end 53 of the hasp opening 53' being spaced from the side wall 46. The opposite side wall 46 has a complementary hasp-receiving recess 54 and a latching finger 56 projecting into the hasp-receiving recess 55. The hasp 48, 52 of a second identical cover 37 will be slidably received along the corresponding, complementary hasp-receiving opening 50, 54 of the other identical cover 37, and will be secured therein by the corresponding latching finger 51, 56, thereby providing latching means to secure together the identical covers 37, 37. The second cover 37 will have its front wall 39 engaging against the rear wall 24 of the body 20 and entering the undercut recesses 30 facing toward the same longitudinal edge of the cover 20. The fingers 28 will overlap the front wall 39 of the second cover 37 and retain the front wall 39 against the rear wall 24 of the body 20.

Although a preferred embodiment of the invention is described other embodiments and modifications are intended to be covered. For example, other fasteners may be used in place of the jack screws 33, 34 and each cover 37 may be molded in one piece of insulative material or fabricated from multiple parts of insulative material.

We claim:

1. An electrical connector, comprising, an insulative body having multiple cavities communicating with a front end and a rear wall of the body, electrical coaxial plugs in respective cavities, the plugs being connected to respective coaxial cables extending from the plugs and projecting from the electrical cable, insulative covers superimposed on one another and covering the coaxial cables, end walls of the covers engaging the electrical cable, latching means on the covers for securing the covers to one another, and recesses in front walls of respective covers, the plugs extending through the front walls and being received in respective recesses, and the front walls partially covering the cavities in the rear wall of the body.

2. An electrical connector as recited in claim 1, and further including, ribs internally of each cover and separating the coaxial cables one from the other.

3. An electrical connector as recited in claim 1, and further including, fingers on the rear wall of the body overlapping a front wall of each cover.

4. An electrical connector as recited in claim 1, and further including, hasp means on each cover cooperating with recess means on each cover for securing the covers together.

5. An electrical connector as recited in claim 1, and further including, fastening means for orienting and removably fastening the body to a panel.

* * * * *